US007993247B1

(12) United States Patent
Eschenbach

(10) Patent No.: US 7,993,247 B1
(45) Date of Patent: Aug. 9, 2011

(54) CHAIR OPERATED ELLIPTICAL EXERCISE APPARAUTS

(76) Inventor: Paul William Eschenbach, Roebuck, SC (US)

( * ) Notice: Subject to any disclaimer, the term of this patent is extended or adjusted under 35 U.S.C. 154(b) by 0 days.

(21) Appl. No.: 12/928,024

(22) Filed: Dec. 2, 2010

(51) Int. Cl.
*A63B 22/04* (2006.01)

(52) U.S. Cl. ..... 482/52; 482/51; 482/57

(58) Field of Classification Search ..... 482/51–57; 434/247
See application file for complete search history.

(56) References Cited

U.S. PATENT DOCUMENTS

| | | | | | |
|---|---|---|---|---|---|
| 3,968,963 | A | * | 7/1976 | Sileo | 272/134 |
| 4,222,376 | A | * | 9/1980 | Praprotnik | 128/25 |
| 4,262,902 | A | * | 4/1981 | Dranselka | 272/132 |
| 4,402,502 | A | * | 9/1983 | Peters | 272/73 |
| 4,572,501 | A | * | 2/1986 | Durham et al. | 272/73 |
| 4,824,132 | A | | 4/1989 | Moore | 280/304.1 |
| 4,846,156 | A | | 7/1989 | Kopnicky | 128/25 R |
| 5,033,736 | A | * | 7/1991 | Hirschfeld | 272/73 |
| 5,106,081 | A | | 4/1992 | Webb | 482/137 |
| 5,356,356 | A | | 10/1994 | Hildebrandt et al. | 482/62 |
| 5,470,298 | A | * | 11/1995 | Curtis | 482/130 |
| 5,472,396 | A | * | 12/1995 | Brazaitis | 482/57 |
| 5,514,053 | A | | 5/1996 | Hawkins | 482/63 |
| 5,611,758 | A | | 3/1997 | Rodgers, Jr. | 482/57 |
| 5,725,457 | A | | 3/1998 | Maresh | 482/57 |
| 5,836,855 | A | | 11/1998 | Eschenbach | 482/57 |
| 5,916,065 | A | | 6/1999 | McBride et al. | 482/57 |
| 5,938,570 | A | | 8/1999 | Maresh | 482/57 |
| 6,036,623 | A | | 3/2000 | Mitchell | 482/57 |
| 6,042,518 | A | | 3/2000 | Hildebrandt et al. | 482/57 |
| 6,077,197 | A | | 6/2000 | Stearns et al. | 482/52 |
| 6,283,895 | B1 | | 9/2001 | Stearns et al. | 482/52 |
| 6,409,635 | B1 | | 6/2002 | Maresh | 482/57 |
| 6,500,099 | B1 | * | 12/2002 | Eschenbach | 482/57 |
| 6,607,470 | B2 | * | 8/2003 | Catanescu et al. | 482/57 |
| 6,666,799 | B2 | | 12/2003 | Hildebrandt et al. | 482/57 |
| 6,790,162 | B1 | | 9/2004 | Ellis et al. | 482/51 |
| 6,840,892 | B1 | | 1/2005 | Wu | 482/51 |
| 6,932,745 | B1 | | 8/2005 | Ellis | 482/52 |
| 6,979,284 | B2 | * | 12/2005 | Curtis | 482/130 |
| 7,086,993 | B1 | | 8/2006 | Maresh | 482/52 |
| 7,497,812 | B2 | * | 3/2009 | Neff et al. | 482/72 |
| 7,833,134 | B2 | * | 11/2010 | Gordon | 482/52 |
| 2004/0259692 | A1 | | 12/2004 | Martin et al. | 482/52 |

* cited by examiner

*Primary Examiner* — Glenn Richman

(57) ABSTRACT

The present invention relates to a sit down exercise apparatus operated in a chair position where foot operated pedals and arm operated handles follow oblong paths. More particularly, the present invention relates to an exercise machine having separately supported pedals for the feet and arm exercise coordinated with motion of the feet. The foot pedals fold away from the operator to allow easy ingress and egress as well as arm exercise only. The handles for arm exercise fold away from the operator for foot only exercise and easy stowage. The exercise apparatus is wheelchair friendly and has a security connector to prevent tipback during operation. Arm exercise can passively exercise the feet or foot exercise can passively exercise the arms.

20 Claims, 4 Drawing Sheets

CHAIR OPERATED ELLIPTICAL EXERCISE APPARAUTS

FIELD

The present invention relates to a sit down exercise apparatus operated in a chair position where foot operated pedals and handles for arm exercise follow an oblong path. More particularly, the present invention relates to an exercise machine having separately supported pedals for the feet and arm exercise coordinated with motion of the feet.

STATE OF THE ART

The benefits of regular exercise to improve overall health, appearance and longevity are well documented in the literature. For exercise enthusiasts, the search continues for safe apparatus that provides full body exercise for maximum benefit in minimum time. Furthermore, the aging population tends to favor seated forms of exercise that encourage muscle tone.

The sit down exercise cycle is the most commonly used apparatus today to elevate the heart rate and exercise some of the leg muscles. To achieve any significant benefit, however, an extensive amount of time is demanded of the user resulting in boredom. To reduce the time needed to elevate the heart rate and exercise additional muscles, various forms of hand cranks and arm levers have been added to sit-down exercise cycles.

Exercise devices with foot pedals to be used for bicycle exercise while seated in a chair are shown by Sileo in U.S. Pat. No. 3,968,963, Dranselka in U.S. Pat. No. 4,262,902 and Brazaitis in U.S. Pat. No. 5,472,396. Exercise apparatus with rotary cranks for hands and feet for chair use is shown by Praprotnik in U.S. Pat. No. 4,222,376. Curtis in U.S. Pat. Nos. 5,470,298 and 6,979,284 shows an exercise chair having a rotary foot crank and oscillating hand grips.

Exercise apparatus for wheelchair use having rotary foot cranks are shown by Hirschfeld in U.S. Pat. No. 5,033,736 and Catanescu et al. in U.S. Pat. No. 6,607,470. Rotary hand and foot cranks for wheelchair use are shown by Peters in U.S. Pat. No. 4,402,502, Durham et al. in U.S. Pat. No. 4,572,501, Moore in U.S. Pat. No. 4,824,132, Kopnicky in U.S. Pat. No. 4,846,156, Mitchell in U.S. Pat. No. 6,036,623 and Wu in U.S. Pat. No. 6,840,892. Some of the wheelchair and chair exercise apparatus have devices to secure the wheelchair or chair to the exercise apparatus.

In recent years, semi-recumbent or more commonly referred to as recumbent exercise apparatus have appeared that provide for back and forth pedal movement to replace the traditional bike crank. Hawkins in U.S. Pat. No. 5,514,053 shows pedals that move back and forth along a linear path. Webb in U.S. Pat. No. 5,106,081 shows a leg exercise machine with pedals that move back and forth along an arc path. Hildebrandt et al. in U.S. Pat. No. 5,356,356 shows pedals that move back and forth along a circular path with arm exercise. Hildebrandt et al. in U.S. Pat. Nos. 6,042,518, 6,666,799 and Ellis et al. in U.S. Pat. No. 6,790,162 show back and forth pedal movement for a recumbent exerciser. Ellis in U.S. Pat. No. 6,932,745 also shows pedals that provide back and forth movement along a circular arc.

Another group of recumbent exercisers are emerging that use elliptical pedal movement for the feet. Rodgers, Jr. in U.S. Pat. No. 5,611,758 shows a recumbent exercise apparatus to generate an elliptical pedal movement using a crank, reciprocating member and roller/track to guide a pedal/foot member pivotally connected to the reciprocating member and a handle member. Eschenbach in U.S. Pat. No. 5,836,855, Maresh in U.S. Pat. Nos. 5,725,457, 5,938,570 and 6,409,635 show elliptical foot motion for recumbent seated operation. Martin et al. in Pat. Application No. US 2004/0259692 shows pedal movements for a semi-recumbent exerciser. Stearns et al. in U.S. Pat. Nos. 6,077,197 and 6,283,895 show inclined pedals with elliptical movement for an operator leaning against a back support. McBride et al. in U.S. Pat. No. 5,916,065 shows elliptical pedal movement intended for stand-up operation in a seated position.

There is a need for a chair operated elliptical cycle that has an elliptical pedal path configured to better utilize the range of leg and foot motion. There is also a need to articulate the pedals to provide dorsi-flexion and plantar flexion foot exercise without raising the heel or toe from the pedal. There is a further need to coordinate elliptical arm exercise with the elliptical foot pedal path exercise for total body exercise that can be adjusted to accommodate the size of the operator. There is a further need to provide foot pedals and arm handles that fold to allow easy ingress and egress. There is a further need to secure the chair or wheelchair to the elliptical exercise apparatus.

SUMMARY OF THE INVENTION

The present invention relates to the kinematic motion control of pedals which provide extended leg exercise for chair exercise. More particularly, apparatus is provided that offers variable intensity exercise through leg operated cyclic motion in which the pedal supporting each foot is guided through successive positions during the motion cycle while a load resistance acts upon the mechanism. Linkage is provided to coordinate elliptical arm exercise.

The operator of the present exercise apparatus is positioned in a chair, recliner or wheelchair which is supported by a horizontal surface. Foot pedals are configured to fold up away from the operator allowing easy ingress and egress. Foot pedals are connected to respective coupler links in a protruding manner between the ends. A pair of crank arms are connected to rotate about a pivot axis positioned upon a framework. Each crank arm is pivotally connected to a respective coupler link. A guide is pivotally connected to one end of each coupler link and to the framework.

A handle for elliptical arm exercise is attached to the other end of each coupler link. Each handle may be adjusted relative to the coupler link to accommodate different size operators. Further, each handle may be folded away from the operator to become parallel to a respective coupler link for foot only exercise and to provide a more compact device for easy storage. Further, both foot pedals may be folded upwards away from the operator for arm only exercise.

A flywheel is rotatably mounted upon the framework driven by a chain and sprockets coupled to the crank arms. Adjustable exercise resistance is achieved using a friction band in contact with the circumference of the flywheel. Of course, other forms of exercise resistance such as magnetic, alternator, etc. may be used with the present exercise apparatus.

The foot pedals follow an elliptical path having the major axis somewhat inclined to the vertical. The handles follow an elliptical path oriented with the major axis inclined to the horizontal and positioned to provide therapeutic shoulder exercise. The toe and heel of the operator generally remain in contact with the pedal while the pedal articulates for dorsi-flexion and plantar flexion exercise.

A security connector is provided to secure a wheelchair or chair to the framework of the exercise apparatus. One example of a security connector is an elastic strap over a horizontal bar and connected to a framework extension which prevents wheelchair tipback.

In summary, the present invention provides elliptical hand and/or foot exercise for an operator seated in a chair or wheelchair. Operator access is enhanced by folding foot pedals and arm handles. Further, the foot pedal motion can passively exercise the arm and shoulder muscles and conversely, the hands can passively exercise the leg muscles of the operator. In addition, with both foot pedals and arm handles folded, the exercise apparatus can be rolled into a closet for storage.

DETAILED DESCRIPTION OF THE EMBODIMENTS

Figure 1:
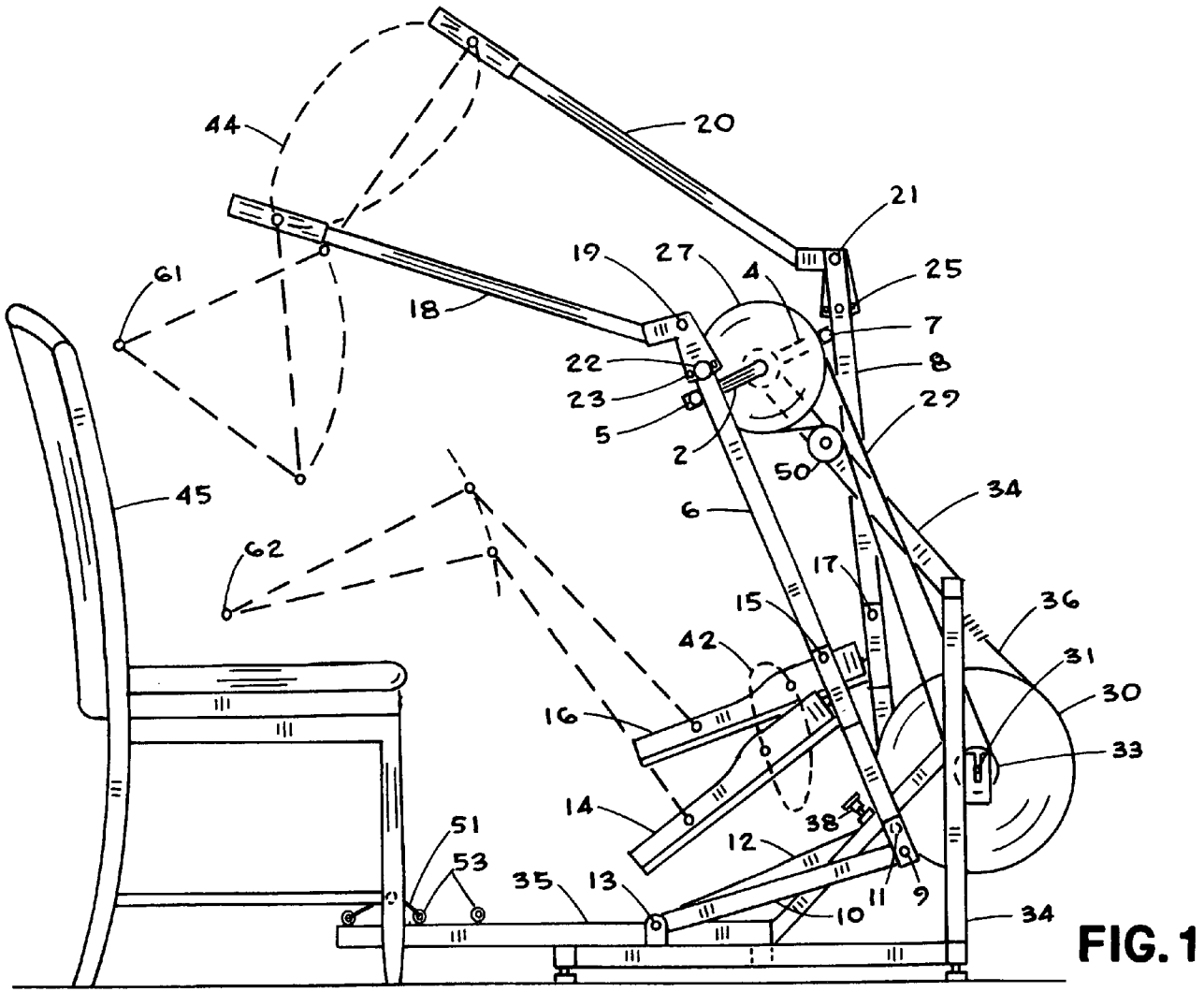
FIG. 1 is a right side elevation view of the preferred embodiment of an exercise machine constructed in accordance with the present invention for an operator seated in a chair.
Figure 2:
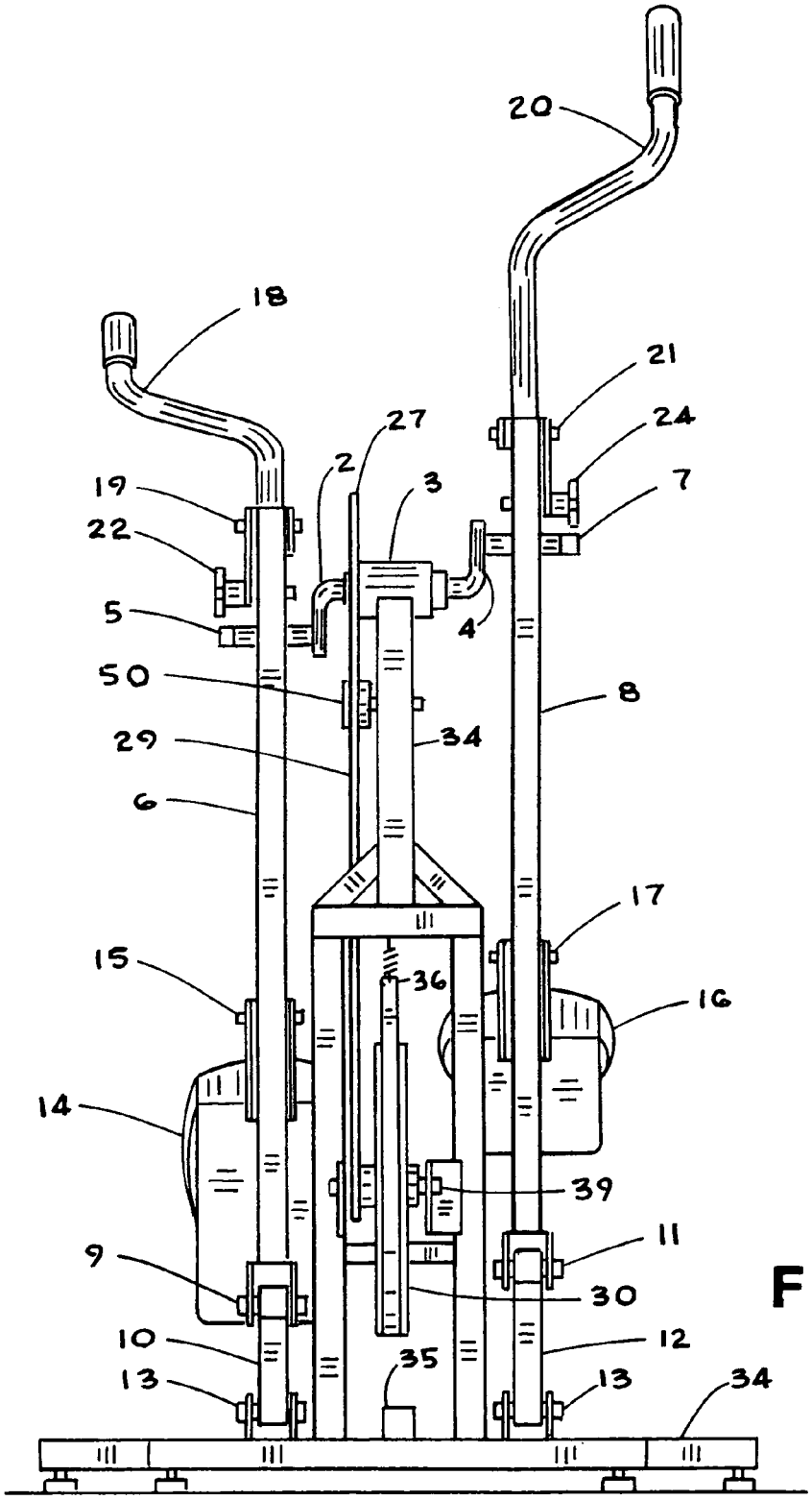
FIG. 2 is an end view of the preferred embodiment of the present invention shown in FIG. 1.

Referring to the drawings in detail, crank arms 2,4 are shown in FIGS. 1 and 2 connected to rotate about pivot axis 3 positioned upon framework 34. Coupler links 6,8 are connected to crank arms 2,4 at pivots 5,7. Guide links 10,12 are connected to one end of coupler links 6,8 at pivots 9,11 and to framework 34 at pivot 13.

Pedals 14,16 are connected to coupler links 6,8 with upper pivots 15,17 and a lower interference with coupler links 6,8 so as to protrude outward. The hip joint 62 of an operator positioned upon chair 45 is shown as a reference for leg exercise. When not in use, pedals 14,16 fold upward about pivots 15,17 for easy ingress and egress. Handles 18,20 are connected to the other ends of coupler links 6,8 at pivots 19,21 and adjustment knobs 22,24. The shoulder joint 61 of an operator seated in chair is shown as a reference for arm exercise. Handles 18,20 may be raised or lowered for operator comfort by repositioning adjustment knobs 22,24 into alternate holes 23,25. Pedals 14,16 follow elliptical curve 42 while handles 18,20 follow elliptical curve 44. During operation, pedals 14,16 articulate providing modest dorsi-flexion and plantar flexion foot rotation about the ankle.

Frame extension 35 is attached to framework 34 and positioned under chair 45. Security connector 51 is attached to frame extension 35 at eyebolts 53 to prevent relative motion between the chair 45 and framework 34. Chair 45 and framework 34 are separately supported by a horizontal surface.

Flywheel 30 is rotatably mounted on framework 34 at pivot 31. Sprocket 27 is attached to crank arms 2,4 and sprocket 33 is attached to flywheel 30. Chain 29 engages sprockets 27,33 and idler 50 to drive flywheel 30. Adjustable resistance is provided by friction belt 36 around the circumference of flywheel 30 using adjustment knob 38.

Figure 3:
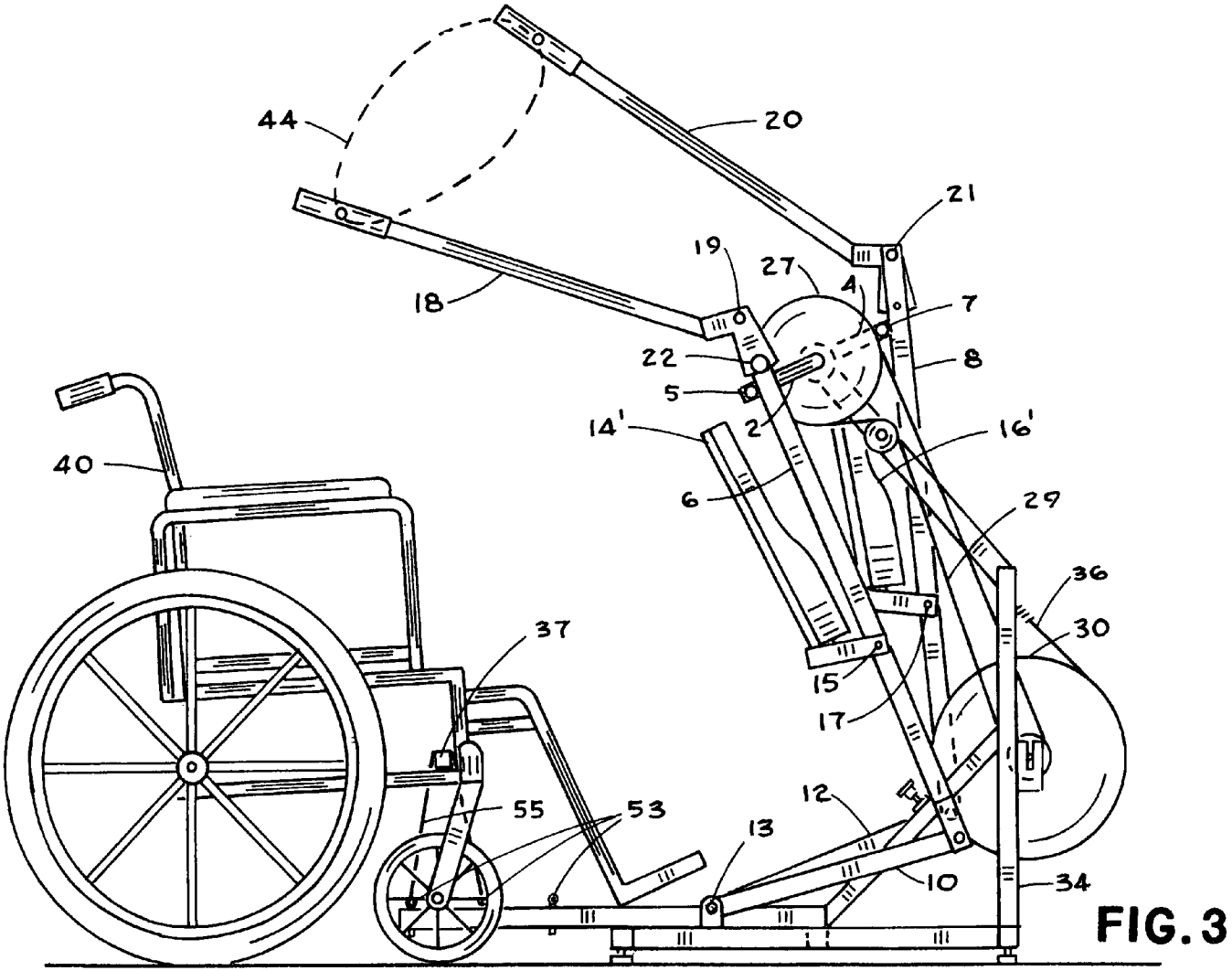
FIG. 3 is a right side elevation view of the preferred embodiment for an operator seated in a wheelchair.

FIG. 3 shows wheelchair 40 supported upon a horizontal surface and coupled to frame extension 35 with elastic strap 55 connected to eyebolts 53 and horizontal bar 37 to prevent wheelchair tipback. Pedals 14' and 16' are shown folded upward around pedal pivots 15,17 to be positioned alongside coupler links 6,8 for arm exercise only. Handles 18,20 follow elliptical curve 44. The remainder of the exercise apparatus is similar to FIG. 1.

Figure 4:
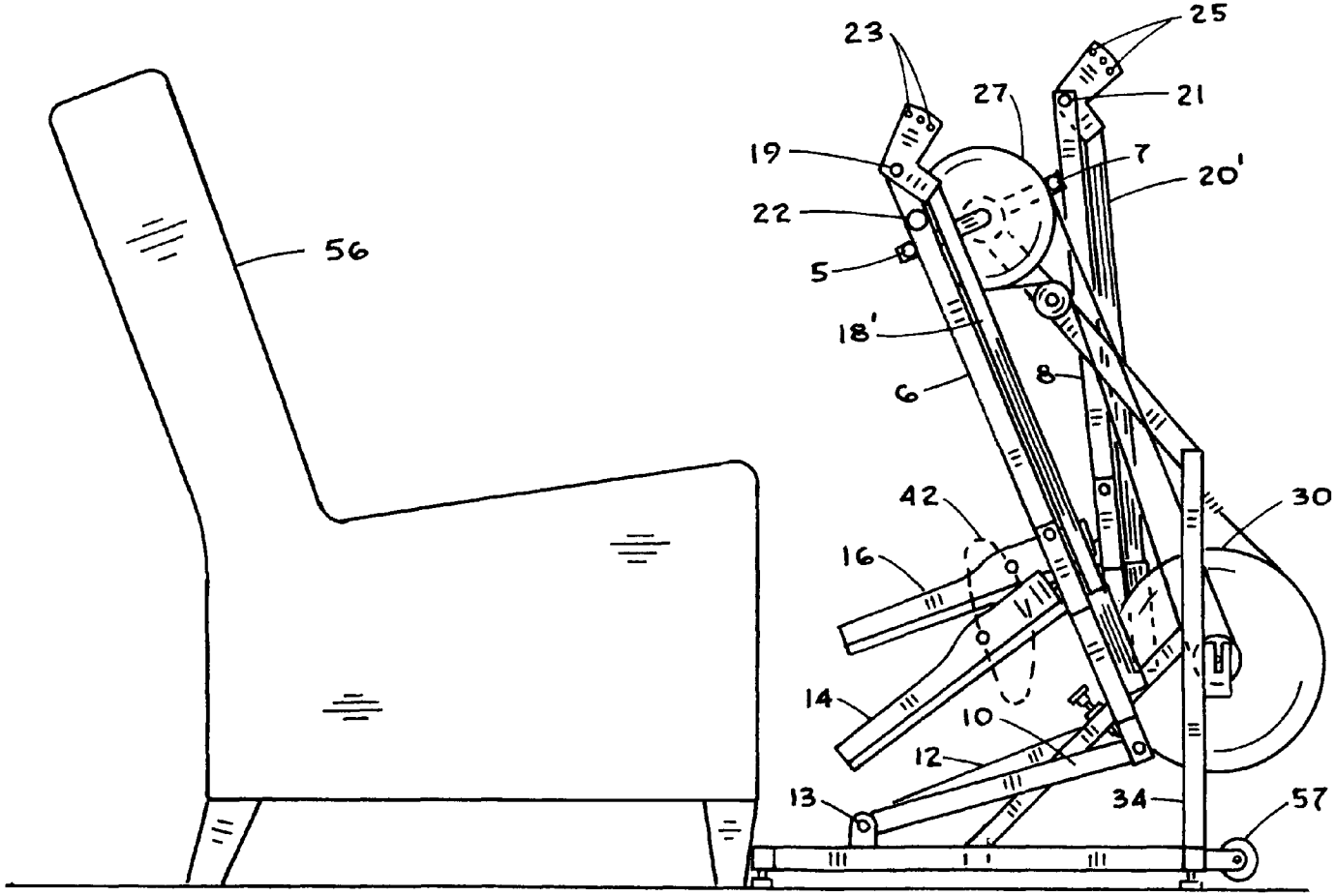
FIG. 4 is a right side elevation view of the preferred embodiment for an operator seated in a recliner.

FIG. 4 shows recliner 56 positioned with legs near framework 34. Pedals 14,16 are positioned for leg exercise while handles 18' and 20' are re-positioned after adjustment knobs 22,24 have been loosened, to be parallel to coupler links 6,8 for leg only exercise. Wheels 57 are added for easy roll around and stowage of the exercise apparatus. The remainder of the exercise apparatus is similar to FIG. 1.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus comprising;

a framework, said framework configured to be supported by a horizontal surface;

a pair of crank arms, said crank arms being connected and configured to rotate about a pivot axis connected to said framework;

a pair of coupler links, each coupler link pivotally connected to a respective said crank arm;

a pair of guide links, each said guide link pivotally connected to one end of a respective said coupler link and pivotally connected to said framework;

a pair of pedals, each said pedal connected to a respective said coupler link between said guide link and said crank arm, protruding outwardly therefrom and each said pedal configured to fold upward to facilitate operator ingress;

a chair, said chair independently supported by said horizontal surface to support a seated operator;

said pedals configured to move relative to said framework when the foot of said seated operator is rotating said crank arms whereby said pedals follow an elliptical path during operation of said pedals.

2. The exercise apparatus according to claim 1 having a pair of handles for arm exercise, each said handle attached to one end of a respective said coupler link and protruding outwardly therefrom.

3. The exercise apparatus according to claim 2 wherein said handles are configured to fold away from said operator to allow foot operation only of said exercise apparatus.

4. The exercise apparatus according to claim 1 further comprising a load resistance device, said load resistance device operably associated with said crank arm.

5. The exercise apparatus according to claim 1 wherein said pedals fold relative to said coupler links to allow arm exercise only using said handles.

6. The exercise apparatus according to claim 1 wherein said chair comprises a wheelchair, said wheelchair positioned proximate said exercise apparatus by said operator.

7. The exercise apparatus according to claim 6 further comprising a security connector, said security connector configured to connect said wheelchair to said framework to prevent tipback of said wheelchair during operation of said exercise apparatus.

8. The exercise apparatus according to claim 2 wherein said handles follow an elliptical path oriented to have the major axis generally vertical to promote shoulder exercise.

9. The exercise apparatus according to claim 1 wherein said elliptical path for said pedals is oriented to have the major axis generally vertical.

10. An exercise apparatus comprising;

a framework, said framework configured to be supported by a horizontal surface;

a pair of crank arms, said crank arms being connected and configured to rotate about a pivot axis connected to said framework;

a pair of coupler links, each coupler link pivotally connected to a respective said crank arm;

a pair of guide links, each said guide link pivotally connected to one end of a respective said coupler link and pivotally connected to said framework;

a chair, said chair independently supported by said horizontal surface to support a seated operator;

a pair of handles for arm exercise, each said handle connected to one end of a respective said coupler link protruding outwardly therefrom;

said handles configured to move relative to said framework when the hand of said seated operator is rotating said crank arms whereby said handles follow an elliptical path that remains above said pivot axis during operation of said pedals.

11. The exercise apparatus according to claim 10 further comprising a handle adjustment device, said handle adjustment device configured to allow said handles to be repositioned relative to said coupler links to achieve handle locations that accommodate said seated operator.

12. The exercise apparatus according to claim 10 having a pair of pedals, each said pedal attached a respective said coupler link and protruding outwardly therefrom.

13. The exercise apparatus according to claim 10 wherein said handle is configured to fold away from said operator to allow foot operation only of said exercise apparatus.

14. The exercise apparatus according to claim 10 wherein said chair comprises a wheelchair, said wheelchair positioned proximate said exercise apparatus by said operator.

15. The exercise apparatus according to claim 14 further comprising a security connector, said security connector configured to connect said wheelchair to said framework to prevent tipback of said wheelchair.

16. An exercise apparatus comprising;

a framework, said framework configured to be supported by a horizontal surface;

a pair of crank arms, said crank arms being connected and configured to rotate about a pivot axis connected to said framework;

a pair of coupler links, each coupler link pivotally connected to a respective said crank arm;

a pair of guide links, each said guide link pivotally connected to one end of a respective said coupler link and pivotally connected to said framework;

a pair of pedals, each said pedal connected to a respective said coupler link between said guide link and said crank arm, protruding outwardly therefrom;

a chair, said chair independently supported by said horizontal surface to support a seated operator;

a pair of handles for arm exercise, each said handle connected to one end of said coupler link;

said pedals and said handles configured to move relative to said framework when the feet and/or the hands of said seated operator are rotating said crank arms whereby said pedals follow an elliptical path such that operation of said pedals can passively provide arm exercise while operation of said handles can passively provide exercise for the feet of said operator.

17. The exercise apparatus according to claim 16 wherein said handles are configured to fold away from said operator to allow foot operation only of said exercise apparatus.

18. The exercise apparatus according to claim 16 wherein said pedals fold relative to said coupler links to allow arm exercise only using said handles.

19. The exercise apparatus according to claim 16 wherein said chair comprises a wheelchair, said wheelchair positioned proximate said exercise apparatus by said operator.

20. The exercise apparatus according to claim 19 further comprising a security connector, said security connector configured to connect said wheelchair to said framework to prevent tipback of said wheelchair.

* * * * *